US005724812A

United States Patent [19]

Baker

[11] Patent Number: 5,724,812

[45] Date of Patent: Mar. 10, 1998

[54] VARIABLE DISPLACEMENT APPARATUS AND METHOD OF USING SAME

[76] Inventor: William E. Baker, 8178 Rimridge La., San Diego, Calif. 92126

[21] Appl. No.: 602,659

[22] Filed: Feb. 16, 1996

[51] Int. Cl.[6] ..... F16D 39/00

[52] U.S. Cl. ..... 60/490; 418/21; 418/28

[58] Field of Search ..... 60/487, 490, 491, 60/486; 418/19, 20, 21, 28

[56] References Cited

U.S. PATENT DOCUMENTS

| | | | |
|---|---|---|---|
| 2,895,422 | 7/1959 | Gold et al. . | |
| 4,740,142 | 4/1988 | Rohs et al. | 418/21 |
| 5,184,947 | 2/1993 | Coombe | 418/21 X |
| 5,203,747 | 4/1993 | Warren | 418/21 X |
| 5,460,084 | 10/1995 | Otremba et al. | 60/486 X |
| 5,477,882 | 12/1995 | Duthie | 60/486 X |

FOREIGN PATENT DOCUMENTS

| | | | |
|---|---|---|---|
| 1297331 | 5/1962 | France | 418/19 |

*Primary Examiner*—Hoang Nguyen
*Attorney, Agent, or Firm*—Bernard L. Kleinke; Peter P. Scott

[57] ABSTRACT

A variable displacement apparatus includes a pair of axially adjustable housing parts sealingly joined together to form a unitary pumping chamber. A pair of meshing elongated vanes or gears having a plurality of teeth disposed within the chamber in a meshing overlapping relationship for positive displacement pumping purposes. The gears are mounted adjustably within the chamber to move axially therein as the housing parts are adjusted axially relative to one another.

12 Claims, 7 Drawing Sheets

VARIABLE DISPLACEMENT APPARATUS AND METHOD OF USING SAME

TECHNICAL FIELD

The present invention relates in general to a variable displacement fluid apparatus and a method of adjusting the flow rate at which fluids pass therethrough. The invention more particularly relates to a variable displacement pumping apparatus which can be utilized to facilitate pumping fluids, and which can be adjusted to change selectively the pumping characteristics of the apparatus to serve a variety of functions, including, but not limited to pumps, variable speed fluid transmissions, multiple fluid delivery systems, and others.

BACKGROUND ART

There have been many different types and kinds of variable, positive displacement pumps or motors for controlling the rate at which fluids pass therethrough. For example, reference may be made to the following U.S. Pat. Nos. 2,696,906; 2,754,765; 2,895,422; 3,151,806; 3,516,764; 3,782,114; and 4,645,439. Each of the referenced patents are incorporated by reference as though fully set forth herein.

U.S. Pat. No. 2,895,422 describes a variable, positive displacement fluid pump or motor that includes a pair of rotary gears each having spaced parallel axes of rotation and each having a plurality of circumferentially spaced teeth and tooth spaces cooperating relative to one another to effect a meshing overlap relation. The individual gears are mounted in separate housing parts which are connected sealing together to form a fluid pumping chamber. The individual housing parts are movable laterally relative to one another to cause the transverse distance between the axes of the gear shafts to be varied adjustably, maintaining the gears in a meshing relationship within the pumping chamber. In this regard, the lateral movement causes the net volume of fluid transported from the pumping chamber inlet port to the chamber outlet port to be adjusted as the transverse distance or spacing between the gear axes is adjusted.

While such a variable, positive displacement pump may have been satisfactory for some applications, it is very limited in its range of adjustment in its operation, since the teeth of the gears move away from a close intermeshing relationship in an adjusted mode of operation. As a result, such a positive displacement pump would not be entirely suitable for some applications, such as mechanical variable speed fluid transmission.

There have been many attempts to design a continuously variable fluid transmission. Ideally, such a transmission would be continuously variable form a large positive turns ratio to a large negative ratio. A transmission which covered such a range would eliminate the need for a separate reverse gear assembly and would greatly simplify the requirements for a clutch or a disengagement assembly. Such a continuously variable fluid transmission could have a variety of different applications, including, but not limited to, power tools, vehicles, and others.

The variable, positive displacement fluid pump or motor disclosed in U.S. Pat. No. 2,895,422 would not be entirely satisfactory for such a fluid transmission, due to the inefficient operation thereof. This is the reason why fluid transmissions, such as those used for automotive applications, have not employed such positive displacement pumps, and instead, employed an unsatisfactory pulley system.

The previous attempts to have a continuously variable fluid transmission have not been entirely satisfactory, since the range over which they could be adjusted is greatly limited and does not approach a zero ratio. They also suffer from the disadvantage that they are relatively inefficient in operation.

Therefore, it would be highly desirable to have a new and improved variable displacement apparatus, which can be used as a mechanical fluid transmission. The mechanical fluid transmission can be adjusted over a wide range, including a zero position in a relatively efficient manner. Moreover, it would be desirable to have such a new and improved variable displacement apparatus, which can operate efficiently for other purposes, including, but not limited to, positive displacement pumps, multiple fluid delivery systems, and others.

DISCLOSURE OF INVENTION

Therefore, the principal object of the present invention is to provide a new and improved variable displacement apparatus and a method of using it in a continuously adjustable manner over a wide operating range of adjustment in a highly efficient manner.

Another object of the present invention is to provide such a variable displacement apparatus and method, wherein such apparatus serves as a mechanical fluid transmission which is continuously variable over a wide range including zero.

Briefly, the above and further objects of the present invention are realized by providing a new and improved variable displacement apparatus, which can be adjusted continuously over a wide operating range.

A variable displacement apparatus includes a pair of axially adjustable housing parts sealingly joined together to form at least one unitary pumping chamber. A pair of meshing elongated vanes or gears having a plurality of teeth is disposed within the chamber in a meshing overlapping relationship for positive displacement pumping purposes. The gears are mounted adjustably within the chamber to move axially therein as the housing parts are adjusted axially relative to one another.

The axial adjustment of the housing parts facilitates large range of volumetric displacement within the pumping chamber while maintaining the meshing overlap relation between the teeth of the gears.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figure 1:
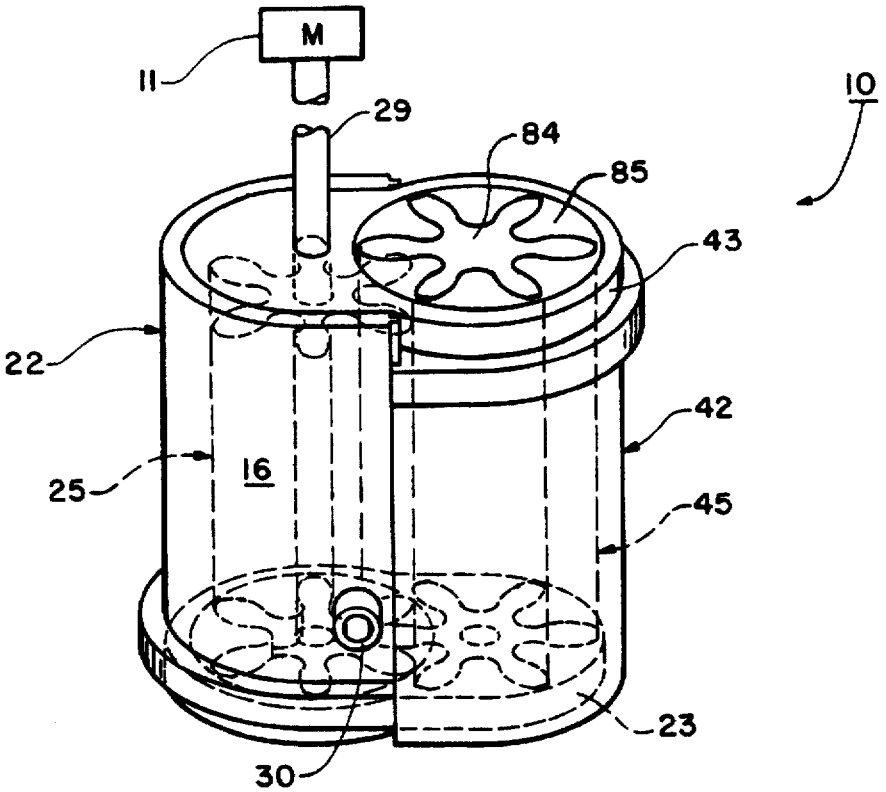
FIG. 1 is a pictorial partly diagrammatic view of a variable displacement apparatus, which is constructed in accordance with the present invention.

Referring now to the drawings, and more particularly to FIGS. 1–5 thereof, there is illustrated a variable displacement apparatus 10, which is constructed in accordance with the present invention. The variable displacement apparatus 10 serves as a variable displacement pump having an interior volume, which can be adjusted continuously in accordance with the adjustment method of the present invention.

In order to motivate the pump 10, a motive source, such as a motor 11 is coupled mechanically thereto. The pump 10 generally comprises a pair of elongated U-shaped housing parts 22 and 42 which are interconnected for relative axial movement. The housing parts 22 and 42 are keyed together in a fluid tight manner to form or define an interior pumping chamber 16 having a continuously variable volume as will be explained hereinafter in greater detail.

A pair of end plate members 23 and 43 are mounted spaced apart from one another on opposing ends of the housing parts 22 and 42, respectively. The end plate members 23 and 43 cooperate with the housing parts 22 and 42 to enable the volume of the pumping chamber 16 to be adjusted continuously when the housing parts 22 and 42 are moved axially relative to one another manually or by a motive device (not shown) which is coupled mechanically to the housing part 22 to move it adjustably axially relative to the stationary housing part 42.

Although the housing part 22 is movable relative to the part 42, those skilled in the art will understand that this arrangement can be readily reversed, where the part 42 is movable and the part 22 is stationary. For some applications, it may be desirable to have both housing parts 22 and 42 mounted in a movable manner so that they can both slide axially relative to one another.

In order to enable the end plates 23 and 43 to help seal the pumping chamber 16, the bottom end plate member 23 is connected fixedly to the housing part 22 in a fluid tight manner and engages slidably an interior wall 44 (FIG. 3) of the pump chamber 16 defined by the housing part 42. In a like manner, the end plate member 43 is connected fixedly to the housing part 42 in a fluid tight manner and engages slidably another interior wall 24 (FIG. 3) of the pumping chamber 16 defined by the housing part 22.

Figure 2:
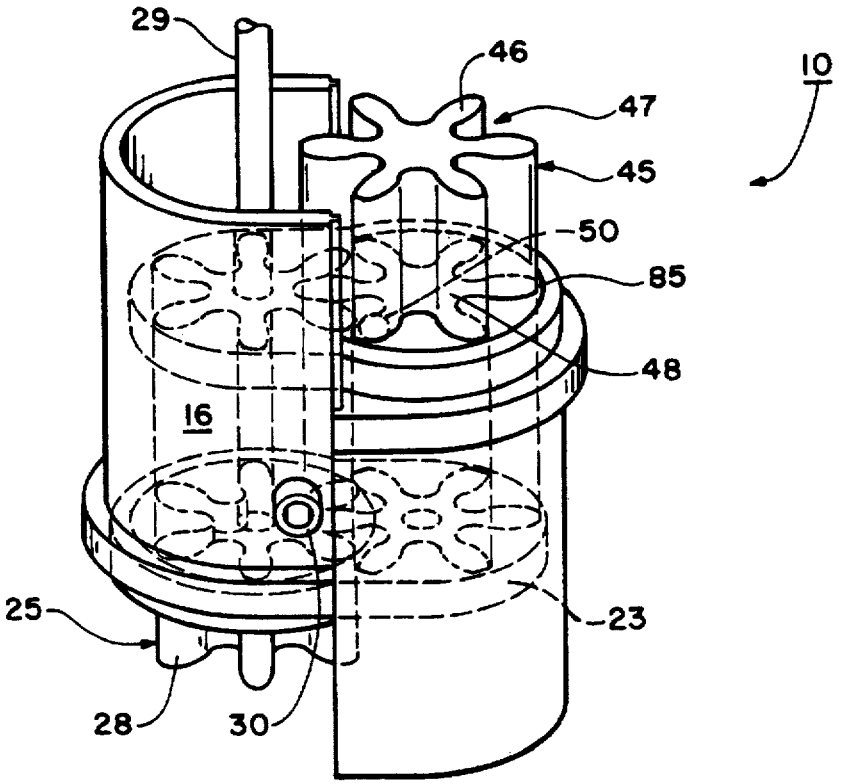
FIG. 2 is a pictorial view of the variable displacement apparatus of FIG. 1, illustrating it being disposed in an adjusted position.

During an adjustment operation as indicated in FIG. 2, the end plate member 43 is carried along an axially extending path of travel by the housing part 42, while the end plate member 23 remains in a fixed stationary position. In this manner, as the end plate members 23 and 43 are moved toward and away from one another, the size or volume of the pumping chamber 16 is decreased and increased continuously and adjustably.

A pair of elongated meshing rotary gears or vanes 25 and 45 are mounted rotatably in a parallel axially extending spaced-apart manner within the pumping chamber 16. Each of the gears 25 and 45 includes a plurality of circumferentially equally spaced apart teeth and tooth spaces, such as teeth 26 and 46 respectively, and tooth spaces 27 and 47 respectively. The gears 25 and 45 cooperate with one another to effect a meshing overlap relation to facilitate pumping of fluids through the pump chamber 16. While each gear is shown and described as having six teeth, other numbers of teeth may also be employed.

Figure 3:
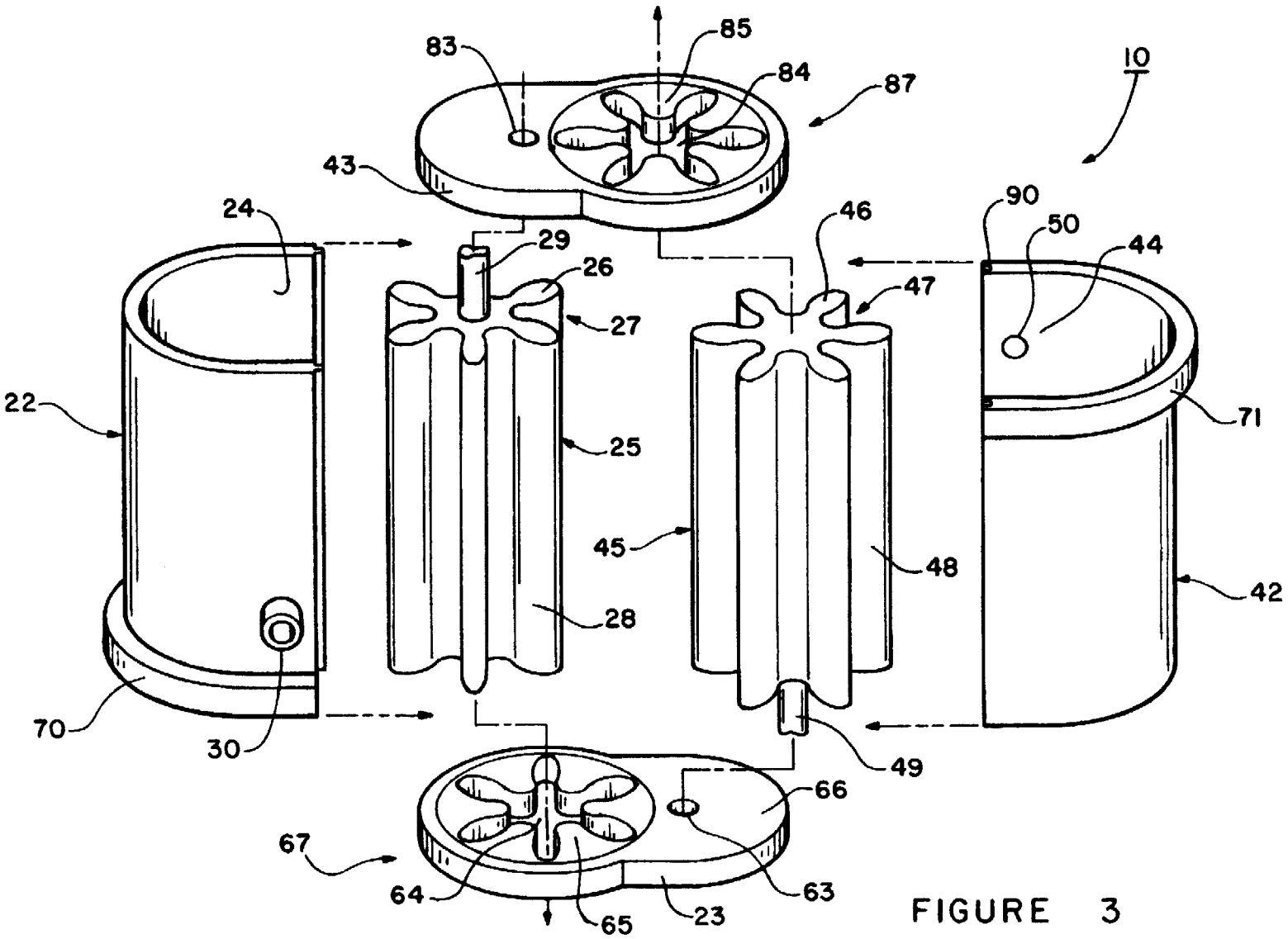
FIG. 3 is an exploded pictorial view of the variable displacement apparatus of FIG. 1.

As best seen in FIG. 3, the gear 25 includes an enlarged body portion 28 which defines the gear teeth and tooth spaces such as tooth 26 and tooth space 27, and a centrally disposed axially extending shaft 29 at one end of the body 28. The top end of the shaft 29 is supported rotatably in an aperture 83 disposed in the end plate member 43. A set of bearings (not shown) are mounted within the aperture 83 to enable the shaft 29 to rotate freely therewith. The shaft 29 is mounted within the aperture 83 in a fluid tight manner by a shaft seal (not shown), and is coupled mechanically drivingly to the output of the motor 11 for rotating the gear 25.

The elongated gear 25 rotates freely within the hollow interior of the pumping chamber 16, but forms a dynamic substantially fluid tight seal with the interior walls of the pumping chamber 16 defined by the housing parts 22 and 42 and the end plates 43 and 23, respectively.

The bottom end of the gear body portion 28 is journalled for rotation axially slidably relative to the bottom end plate 23 within a shaped opening 64 of a circular plate 65 mounted rotatably within a circular opening in the end plate member 23. The rotary plate 65 is sealed dynamically in a fluid tight manner by means (not shown) to the end plate member 23.

The shaped opening 64 is complementary shaped relative to the cross-sectional configuration of the body portion 28 and receives the body portion 28 axially slidably therewithin in a fluid tight manner. In this regard, as best seen in FIG. 2, a substantial portion of the body 28 is enabled to extend axially outwardly below the interior of the pumping chamber 16 as the associated housing parts 22 and 42 are moved axially relative to one another into an adjusted position.

In the above manner, the gear 25 is mounted rotatably between the end plate members 23 and 43 and rotatably axially slidably in end plate member 23. In this regard, the gear 25 is adapted to move axially within the pumping chamber 16 for helping to permit the volume of fluid passing through the chamber 16 to be adjusted continuously. In this regard, by permitting the gear 25 to extend partially rotatingly through the bottom end plate 23 as shown in FIG. 2, the volume of the interior of the pumping chambers is smaller than the volume of the chamber 16 in the position of FIG. 1.

As best seen in FIG. 3, the elongated gear 45 is similar to the gear 25 and includes an axially elongated body portion 48 which defines the gear teeth and tooth spaces, such as tooth 46 and tooth space 47, and a centrally disposed axially extending shaft 49 at the bottom end of the portion body 48. The gear 45 is journalled for rotation about its ends in a similar manner as the gear 25. The shaft 49 is supported rotatably in an aperture 63 disposed in the end plate member 23. A set of shaft bearings (not shown) are mounted within the aperture 63 to enable the shaft 49 to rotate freely therein. A seal (not shown) dynamically seals the shaft 49 rotatably in the aperture 63 in a fluid tight manner.

The elongated gear 45 is free to rotate within the hollow interior of the pumping chamber 16 and forms a dynamically substantially fluid tight seal with the interior pumping chamber walls.

The top end of the body portion 48 is journalled for axially slidable rotation relative to the top end plate 43 within a shaped opening 84 of a plate 85 mounted rotatably in the end plate member 43. The rotary plate 85 is sealed dynamically to the end plate member 43 in a fluid tight manner by means not shown.

The shaped opening 84 is complementary shaped relative to the cross sectional configuration of the body portion 48 and receives the body portion 48 axially slidably therewithin in a fluid tight manner. In this regard, as best seen in FIG. 2, a substantial portion of the body 48 is enabled to extend axially outwardly above the interior of the pumping chamber 16 as the associated housing parts 22 and 42 are moved axially relative to one another into the adjusted position.

Thus, in a manner similar to the gear 25, the gear 45 is mounted rotatably between the end plate member 23 and 43 and rotatably axially slidably in the rotary plate 85 mounted to the end plate member 43. In this regard, the gear 45 is adapted to move axially within the pumping chamber 16 for helping to enable the volume of the fluid passing through the chamber 16 to be adjusted, while remaining in a constant close meshing relationship at all times with the gear 25.

Figure 4:
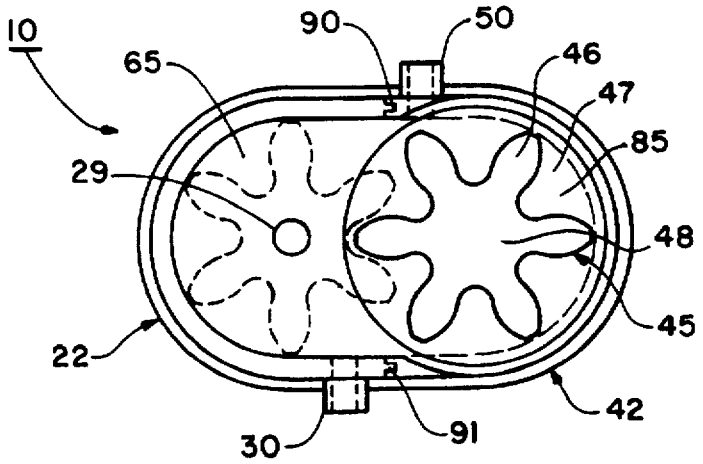
FIG. 4 is a top plan view of the variable displacement apparatus of FIG. 1.
Figure 5:
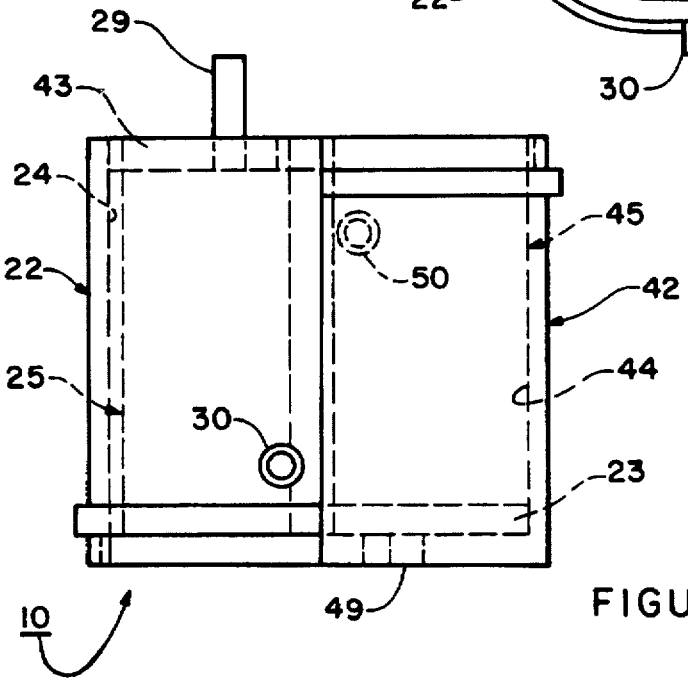
FIG. 5 is a side elevational view of the variable displacement apparatus of FIG. 1.

As best seen in FIG. 4, in order to enable fluids to enter into the chamber 16 and to be discharged therefrom in response to the gears 25 and 45 rotating therewithin, the housing parts 22 and 44 include respectively an inlet opening 30 and an outlet opening 50.

As best seen in FIG. 4, the housing parts 22 and 42 have engaging abutting longitudinal surfaces in a pair of keyed channels indicated generally at 90 and 91. The channels 90 and 91 are parallel to the axes of the shafts 29 and 49, and are dynamically sealed together. Thus, movement of the housing part 22 relative to the housing part 42 along the channels 90 and 91 cause a change in the spacing between the end plates 23 and 43, which in turn, causes a portion of the gears 25 and 45 to move axially into and out of the pumping chamber 16 as they rotate slidably through their respective rotatable plates, 65 and 85.

In FIG. 1, the housing parts 22 and 42 are shown in a starting maximum volume position, where the distance between the end plate members 23 and 43 is substantially at a maximum distance to permit a maximum volume of fluids to be discharged from the pumping chamber 16 via its outlet.

In FIG. 2, the housing parts 22 and 42 are shown in an intermediate adjusted position where the perpendicular distance between the end plate member 23 and 43 has been significantly decreased relative to the spacing distance shown in FIG. 1. In this regard, the end plate members 23 and 43 function as the ceiling and floor of the adjustable size interior of the pumping chamber 16 and cooperate with the interior walls of the housing parts 22 and 42, to define the volume or size of the pumping chamber 16. Thus, as the end plates 23 and 43 are spaced closer together as compared to the distance illustrated in FIG. 1, the volume becomes significantly decreased. Thus, a much smaller volume of fluid is discharged from the pump 10 in response to each rotation of the gears 25 and 45.

When the spacing dimension between the end plates 23 and 43 is decreased or increased in accordance with the adjustment method of the present invention as illustrated in FIGS. 1 and 2, the gears 25 and 45 maintain a parallel, spaced-apart co-axial relation with respect to the respective housing parts 22 and 42 defining the pumping chamber 16. The respective gears 25 and 45 remain at all times in a substantially fluid tight meshing relation with the interior walls 24 and 44, respectively, as well as the floor and ceiling of the chamber 16 defined by the end plate members. In this manner, as illustrated in FIG. 2, although the gears 25 and 45 are maintained in an axial parallel spaced-apart relation, the tooth spaces, such as spaces 27 and 47 are not filled with as much fluid as they were when the end plates 23 and 43 were spaced at the maximum spaced distance as illustrated in FIG. 1. Because of this characteristic, the net volume of fluid transported from the inlet 30 to the outlet 50 in a complete revolution of the gears 25 and 45 is adjustable continuously, as the axial distance or spacing dimension between the floor 23 and ceiling 43 of the pumping chamber 16 has been substantially varied, thus adjusting the interior volume of the pumping chamber 16.

The net volume of fluids transported through the pump 10 in a complete revolution of the gears 25 and 45 is reduced as the end plate members 23 and 43 are moved axially toward one another.

As best seen in FIGS. 1–3, the side housing part 22 generally includes a U-shaped external bottom flange 70 disposed adjacent to the port 30 which is dimensioned for receiving an end portion 67 of an end plate 23 therein. The end plate 23 extends between the side housing parts 22 and 42, respectively and is dynamically sealed to the side housing parts 22 and 42 to partially seal the one end of the pump 10.

As the side housings 22 and 42 are moved relative to one another, the side housing 22 causes the end plate 23 to move axially slidably along the inner wall member 44 of the housing 42.

As best seen in FIG. 3, the side housing part 42 is substantially similar to side housing 22, and includes another U-shaped external top flange 71 disposed adjacent to the port 50 which is dimensioned for receiving an end portion 87 of the end plate 43 therein. The end plate 43 extends between the side housing members 22 and 42, respectively, and is dynamically sealed to the inner wall member 24 to partially seal the other end of the pump 10.

As the side housing members 22 and 42 are moved axially relative to one another, they carry their respective end plates 23 and 43 toward and away from one another to cause the interior volume of pumping chamber 16 to be significantly adjusted. The large change in the interior volume of the chamber 16 permits the apparatus 10 to function over a wide range of fluid displacement. Thus, the apparatus 10 can be utilized in a variety of applications including a variable positive displacement pump, a continuously variable hydraulic transmission, multiple delivery systems and other applications.

In order to permit fluid to pass through the interior of the apparatus 10, the gears 25 and 45 rotate in a dynamically sealed manner relative to the inner walls 24 and 44 of the side housings 22 and 42 respectively, to provide the desired positive displacement pumping operation.

Considering now the operation of the apparatus 10 in greater detail with reference to FIGS. 1 and 2, the ports 30 and 50 permit fluid to enter a fluid receiving chamber 16 within the interior of the apparatus 10 and to be discharged therefrom as the axle 29 is driven by the motive means 11.

The volume of the chamber 16, and the rate at which the fluid is discharged from the chamber 16 is directly related to the distance the end plates 23 and 43 are spaced apart from one another. As the end plates 23 and 43 are moved toward and away from one another, the volume of the chamber 16 decreases and increases respectively between a minimum volume and a maximum volume. Thus, the rate at which the fluid passes through the chamber 16 decreases and increases in a corresponding manner.

Figure 6:
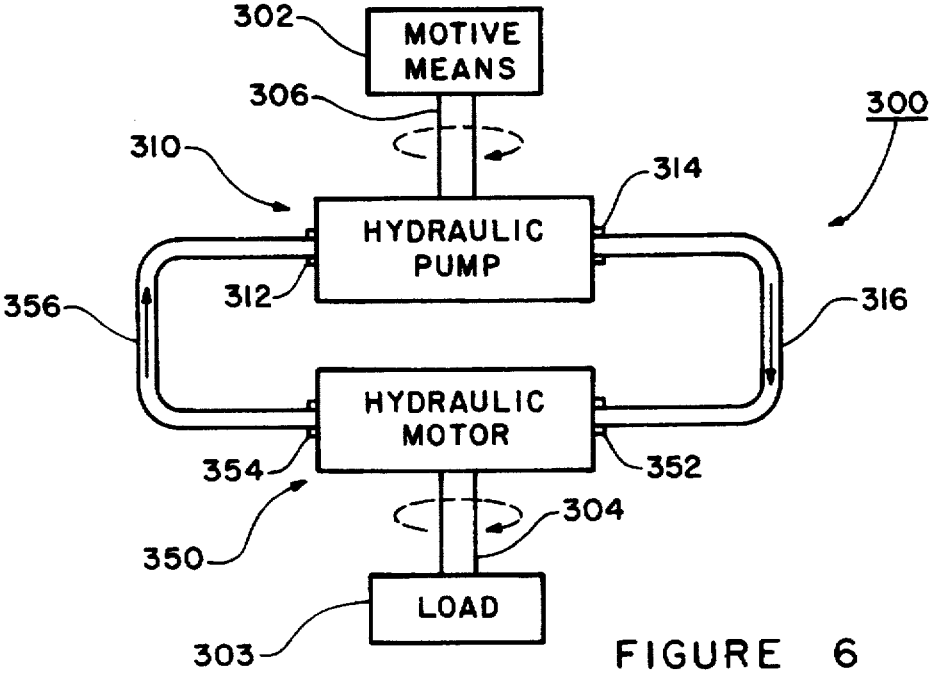
FIG. 6 is a diagrammatic view of another variable displacement apparatus, which is also constructed in accordance with the present invention as a fluid transmission.

Referring now to the drawings and more particularly to FIG. 6 thereof, there is shown a variable displacement apparatus 300 which is constructed in accordance with the present invention, and which is illustrated connected between a power source, such as a motor 302 and a load 303 having a driven shaft 304. The variable displacement apparatus 300 is constructed to selectively change the rotational speed of the driven shaft 304 continuously to permit the apparatus to function as a continuously variable hydraulic transmission in accordance with the adjustment method of the present invention. This transmission functions in a single direction only.

The apparatus 300 generally comprises a variable displacement pump 310 and a hydraulic motor 350 which are coupled respectively to the motor 302, via a drive shaft 306 and the driven shaft 304. The variable displacement pump 310 is substantially similar to the variable displacement apparatus 10 and will not be discussed in greater detail except as required to describe the present invention. The hydraulic motor 350 is a conventional hydraulic motor whose output speed varies with the flow rate of a driving fluid stream.

The pump 310 and motor 350 are connected in fluid communication by a pair of fluid carrying tubular members 316 and 356. Tubular member 316 is connected between an output port 314 of the pump 310 and an input port 352 of the motor 350. In a similar manner, the tubular member 356 is connected between an output port 354 of the motor 350 and an input port 312 of the pump 310.

As the pump 310 and motor 350 are arranged in a closed system arrangement, those skilled in the art will understand that the volume of fluid circulating within the variable displacement apparatus 300 is substantially constant. Stated otherwise, the power transmitted by the motor 302 to cause a constant discharge of fluid from the output port 314 of pump 310, to the input port 352 of motor 350, will be absorbed by the motor 350 and converted into rotational energy as the fluid passes from the input port 352 to the output 354 of the motor 350. Such rotational energy is utilized for causing the driven shaft 304 to be driven at a desired rate of rotation in accordance with the method of the present invention.

As the apparatus 300 is a closed system, the volume of fluid discharged from the output port 314 of pump 310 must equal the volume of fluid discharged from the output port 354 of the motor 350. Thus, for example, if pump 310 is discharging 15 cubic inches of fluid, the motor 350 must discharge a like volume of fluid. In this regard, if the fluid volume output of pump 310 is 15 cubic inches per second then the fluid output of the motor 350 will be equal to the same flow rate of 15 cubic inches per second. Thus, a 1:1 fluid volume output relationship is established between the pump 310 and the motor 350.

Considering now the operation of the system 300 in greater detail with reference to FIG. 6, the interior volume of the motor 350 is fixed and not adjustable. Thus, as the fluid output discharge of the pump 310 is adjustably increased, the volume per unit time of fluid passing to the motor 350 via the conduit 316 is likewise increased. In this regard, the volume per unit time output of the motor 350 must equal the volume per unit time output of the pump 310. Thus, the motor 350 responds to the increased discharge by increasing the rotational speed of the driven shaft 304. Table I best describes the relationship between the pump 310 and the motor 350 as a function of the discharge rate of the pump 310 and the rotational speed of the load shaft 304.

TABLE I

| PUMP 310 OUTPUT CAPACITY | ROTATIONAL SPEED OF LOAD SHAFT 304 RELATIVE TO DRIVER SHAFT 306 |
|---|---|
| 15 cubic in/sec | 1:1 |
| 30 cubic in/sec | 2:1 |
| 60 cubic in/sec | 4:1 |

From the foregoing, it should be understood by those skilled in the art that the variable displacement apparatus 300 functions as a true continuously variable hydraulic transmission as the discharge rate of motor 350 must always equal the discharge rate of pump 310.

Figure 7:
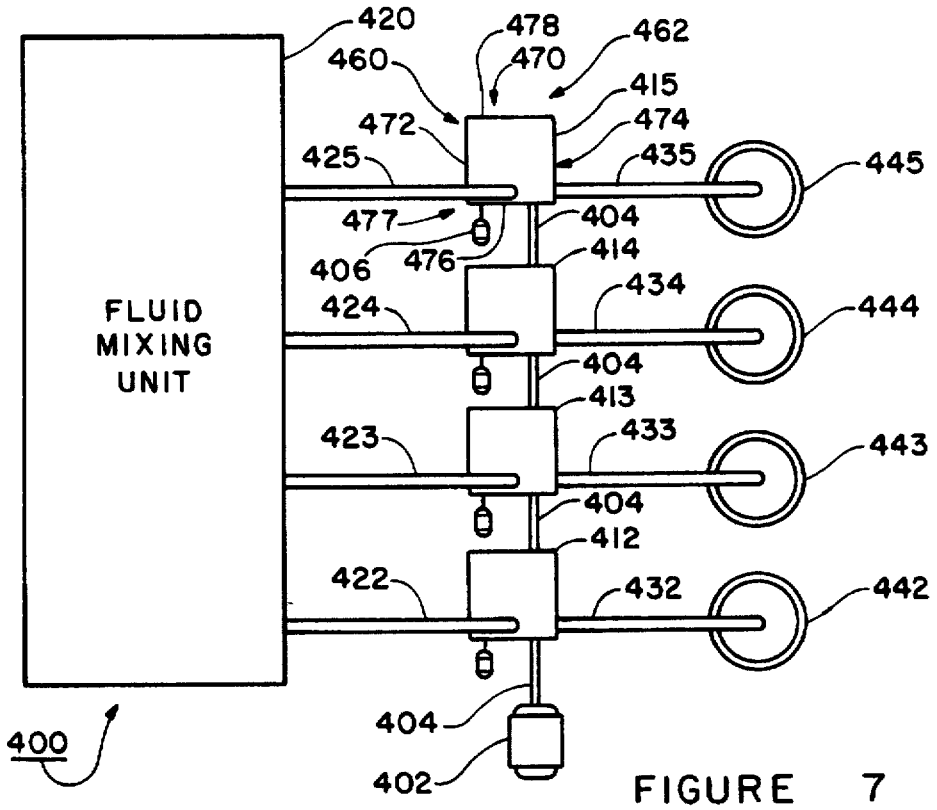
FIG. 7 is a diagrammatic view of a further variable displacement apparatus, which is constructed in accordance with the present invention, and which utilizes a plurality of devices similar to the apparatus of FIG. 1 as a multiple delivery system.

Referring now to the drawings and more particularly to FIG. 7 thereof, there is shown a variable displacement apparatus 400 which is constructed in accordance with the present invention and which is illustrated coupled to a power source 402 via a common drive shaft 404. The variable displacement apparatus 400 is constructed to change selectively its discharge rates to function as a multiple delivery system in accordance with the adjustment method of the present invention.

The apparatus 400 generally comprises a plurality of like variable displacement pump units 412–415 which are coupled between a fluid mixing unit 420 via a set of conduits 422–425 respectively, and a plurality of fluid delivery units 442–445 via another set of conduits 432–435. The individual pump units 412–415 are further connected to the power source 402 via the drive shaft 404. In this manner, the pump units 412–415 operate in unison. Each of the variable displacement pump units 412–415 are substantially similar to the variable displacement apparatus 10 and will not be discussed in greater detail except as required to describe the present invention.

Each of the pump units 412–415, such as pump unit 415 includes a pair of axially adjustable housing members, a pair of elongated rotary gears or vanes 460 and 462 respectively, having spaced parallel axes of rotation relative to one another. The gears 460, 462 are disposed within a pumping chamber 470 in a meshing overlay relation to permit the gears 460, 462 to cooperate with one another.

The chamber 470 is formed by a pair of axially adjustable housing members or parts 472 and 474 respectively and a pair of spaced apart end plates 476 and 478 which are fixedly secured to housing members 472 and 474 respectively.

The end plates 476 and 478 each include a rotatable plate, such as a rotatable plate 477 for supporting rotatably slidably, a given one of the gears, such as the gear 462.

Upon effective relative axially movement between the housing members 472 and 474, the respective gears are moved axially rotatably in parallel planes slidably through respective ones of their associated end plates, such as rotatable plate 477. In this manner of adjustment, the volume of the pumping chamber 470 is reduced as the end plates travel toward one another.

Each of the pump units 412–415, such as the pump unit 415 is further coupled to a housing motor, such as the housing motor 406. The housing motor 406 drives the housing members 472 and 474 axially along a common axis to cause the end plates to be adjusted toward and away from one another. In this manner, the housing motors can adjust the displacements of the pumps 412–415 to maintain the proper ratio of the fluids being delivered to fluid mixing unit 420 from the respective ones of the fluid delivery units 442–445.

Figure 8:
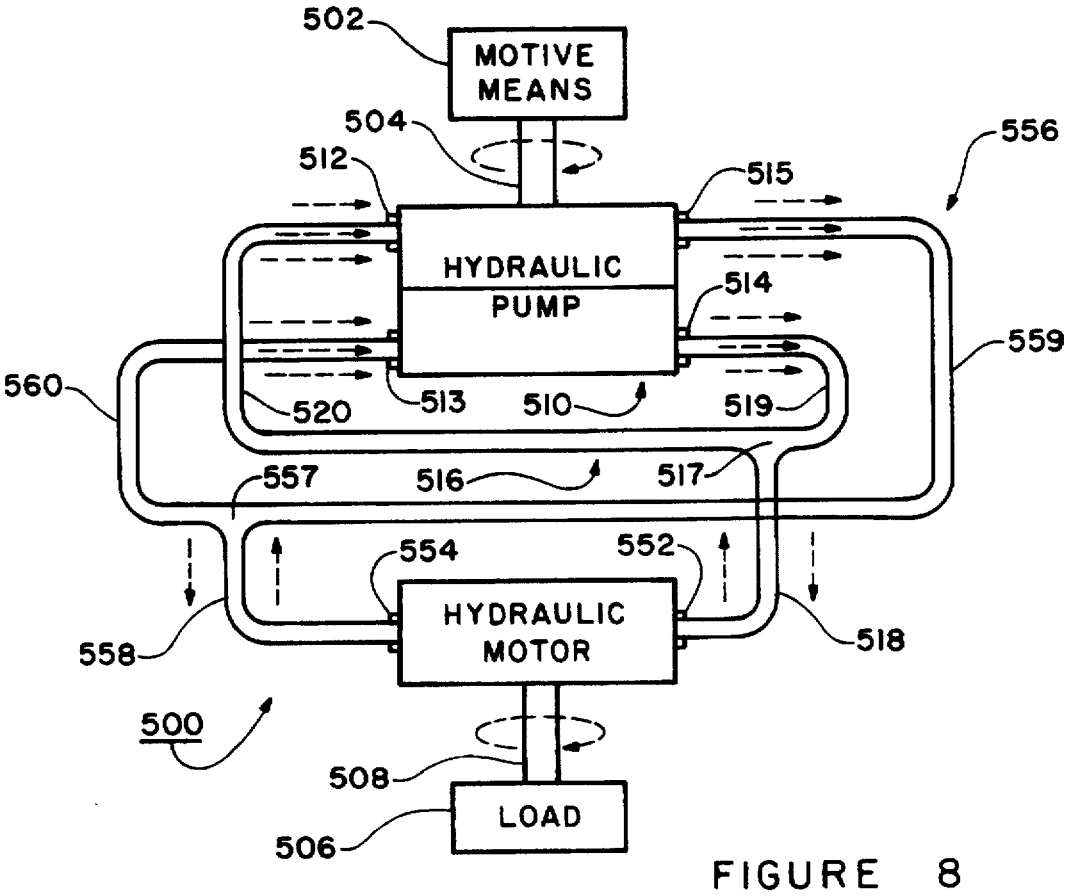
FIG. 8 is a diagrammatic view of another variable displacement apparatus, which is constructed in accordance with the present invention, and which utilizes an apparatus similar to the one of FIG. 1 as a continuously variable speed fluid transmission operable in both forward and reverse directions.
Figure 10:
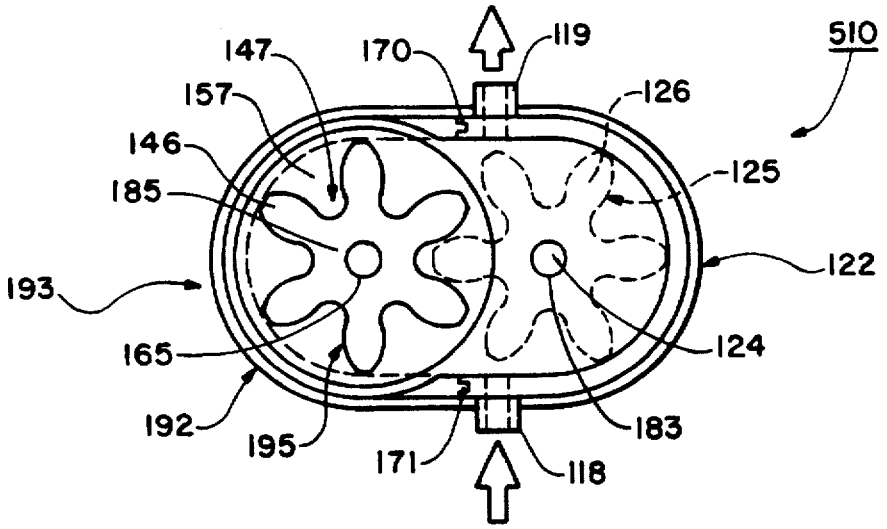
FIG. 10 is a top plan view of the variable displacement apparatus component of FIG. 9.

Referring now to the drawings and more particularly to FIG. 8 thereof, there is shown a variable displacement apparatus 500 which is constructed in accordance with the present invention and which is illustrated coupled to a power source or motor 502 via a common drive shaft 504 and a load 506 via a driven shaft 508. The variable displacement apparatus 500 is constructed to selectively change the rotational speed of the driven shaft 508, in two directions.

The apparatus 500 generally comprises a variable displacement hydraulic pump 510 and a hydraulic motor 550 having a pair of port openings 552 and 554. The pump 510 and motor 550 are coupled respectively to the motor 502 via the drive shaft 504 and the load 506 via the driven shaft 508. The hydraulic motor 550 is substantially similar to motor 350 and will not be described in greater detail.

The pump 510 and motor 550 are connected in fluid communication by a pair of manifold units 516 and 556, respectively.

The manifold unit 516 generally comprises a tee member 517 having a common conduit member 518 in fluid communication with the motor port 552, a pump output conduit 519 connected between the tee member 517 and a first pump output port 514 of the pump 510 and a pump input conduit 520 connected between the tee member 517 and a first pump input port 512 of the pump 510.

The manifold unit 556 generally comprises another tee member 557 having another common conduit member 558 in fluid connection with the other motor port 554, another pump output conduit 559 connected between the tee member 557 and a second pump output port 515 of the pump 510 and another pump input conduit 560 connected between the tee member 557 and a second pump input port 513 of the pump 510.

As the pump 510 and the motor 550 are arranged in a closed system arrangement, those skilled in the art will understand that the volume of fluid passing between the tee members 517 and 557 and the pump 510 must be equal. Thus, when the volume of fluid discharged from the pump output ports 514 and 515 is equal to one another, no fluid will flow to the motor 550 via conduits 518 and 558, and thus, the driven shaft 508 will not be rotated.

Considering now the operation of the variable displacement apparatus 500 in greater detail with reference to FIG. 8, when the pump 510 has been adjusted to provide a maximum output flow from the output port 514 and a minimum output flow from the output port 515, fluid passes along the manifolds 516 and 557 to the pump input ports 512 and 513 respectively. In this regard, the flow into the first input port 512 must equal the flow out of the output port 515 and the flow into the second input port 513 must equal the flow out of the output port 514.

In operation, as a first example, when the flow in manifold conduit 559 is a maximum flow, the flow can not be absorbed by the pump 510 via the input port 513 as the output port 514 is discharging a minimum flow. In this regard, the excess fluid that is unable to enter the pump 510 via the input port 513 is diverted via the tee member 557 to the common conduit 558 to the port opening 554 causing the driven shaft 508 to be driven in one rotational direction as the fluid passes through the motor and out to the common conduit 518 via the port opening 552.

The fluid discharged into the common conduit 518 passes to the tee member 517 and combines with the minimum flow of fluid in conduit 519 to create a maximum flow in conduit 520 which is passed to the input port 512 of the pump 510 via the conduit 520. This resulting flow is equal to the maximum discharge rate of the pump 510 from the output port 515.

In a like manner, as another example, when the pump 510 has been adjusted to provide a maximum output flow from the other output port 514, and a minimum output flow from the output port 515, fluid passes along the manifolds 516 and 556 to the pump input ports 512 and 513 respectively. In this regard, the flow to the second input port 513 must equal the flow out of the output port 514 and the flow to the first input port 512 must equal the flow out of the first output port 515.

In operation then, as the fluid flow in manifold conduit 519 is a maximum flow, the pump 510 will not be able to absorb the flow via the input port 512. Thus, the excess fluid flow to port 512 is diverted via the tee member 517 to the common conduit 518 and to the port opening 552 causing the driven shaft 508 to be driven in another rotational direction as the fluid passes through the motor 550 and out to the common conduit 558 via the port opening 554.

The fluid discharged into the common conduit 558 passes to the tee member 557 and combines with the flow of fluid in conduit 559 which is a minimum flow to produce a maximum flow which then passes to the input port 513 of the pump 510 via the conduit 560. This resulting flow is equal to the maximum discharge rate of the pump 510 from the output port 514.

From the foregoing, those skilled in the art will understand that as the flow discharge rates from the output ports 514 and 515 are adjusted, the rotational speed of the driven shaft 508 will proceed from a maximum rotational speed in one direction to no rotation and then to a maximum rotational speed in an opposite direction and visa versa. Thus, the apparatus 500 is a true variable displacement apparatus.

Referring now to the drawings, and more particularly to FIGS. 9–13 thereof, there is shown the hydraulic pump 510 which is constructed in accordance with the present invention. The flow rate of hydraulic pump 510 can be varied readily from a large positive value, through zero, to a large negative value or visa versa, in accordance with the flow adjustment method of the present invention.

The hydraulic pump 510 generally comprises a set of three elongated U-shaped side housing parts 122, 142 and 192, respectively. The side housing members 122 and 142 are interconnected for relative axial movement with housing part 192 and are dynamically sealed together at their respective longitudinal boundaries by a pair of sealed keyways 170 and 171 and are adapted by means (not shown) to be adjusted axially relative to one another without rupturing the dynamic seal.

Figure 9:
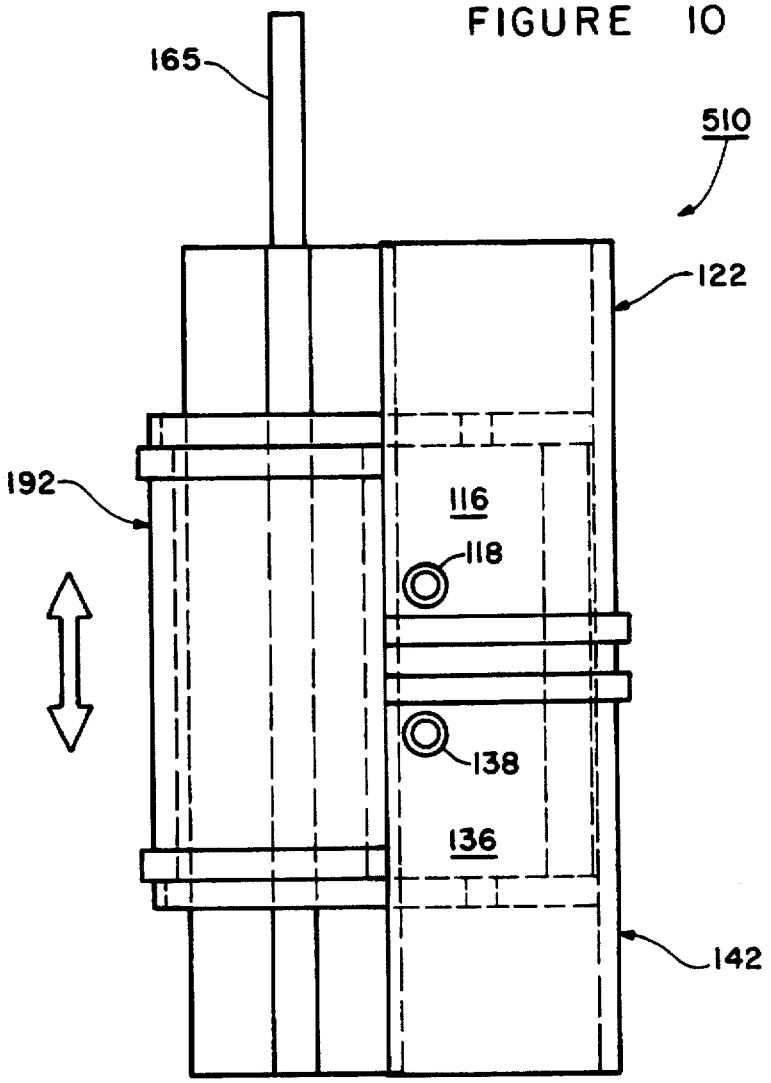
FIG. 9 is a side elevational view of the variable displacement apparatus component of the transmission apparatus of FIG. 8.
Figure 11:
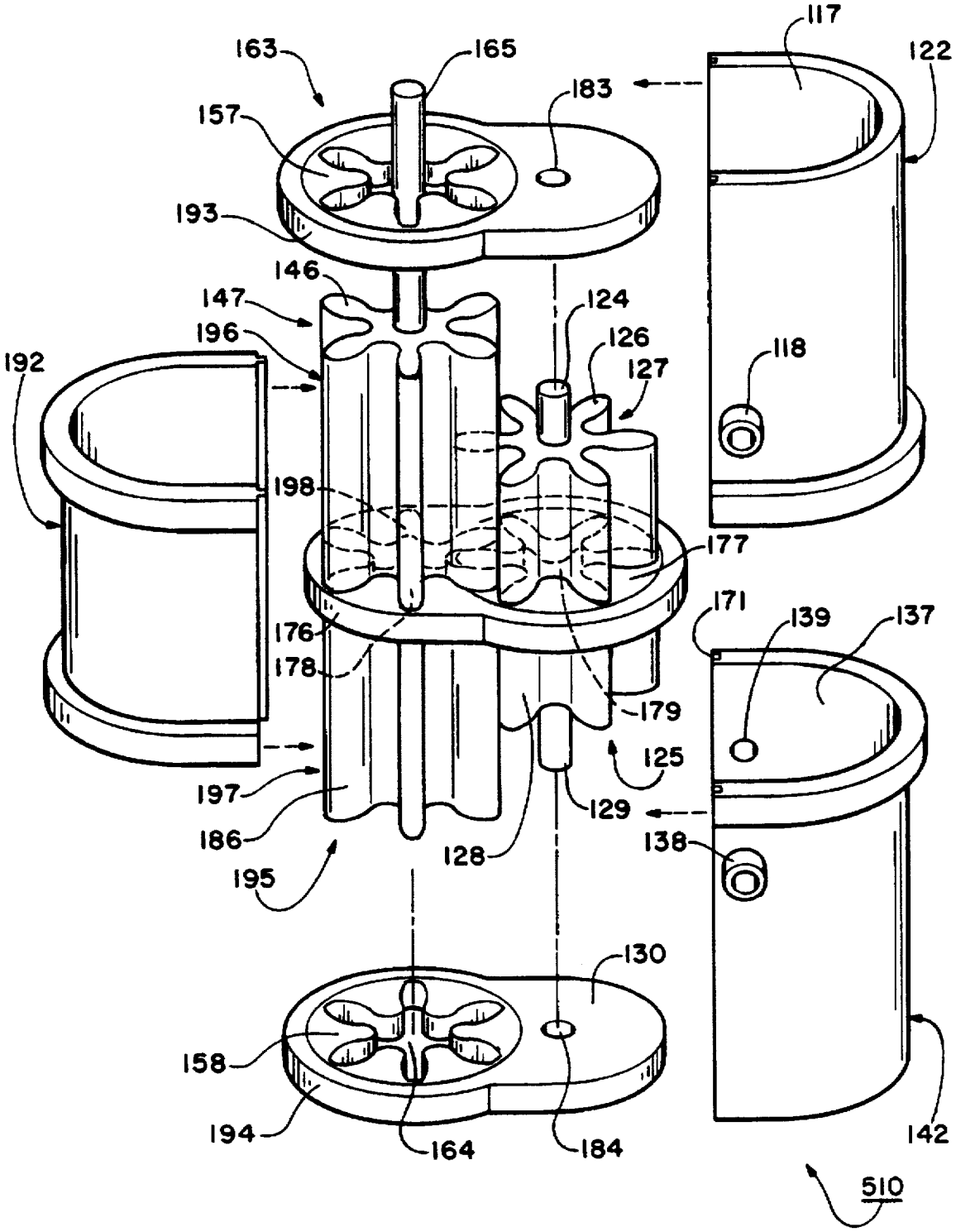
FIG. 11 is an exploded pictorial view of a component of the variable displacement apparatus component of FIG. 9.

A pair of end plate members 193 and 194, as best seen in FIG. 11, are mounted spaced apart from one another on opposing ends of the housing part 192 and cooperate with an intermediate chamber plate member 176 to help define a pair of pumping chambers 116 and 136, as shown in FIG. 9. The intermediate chamber plate 176 is mounted fixedly at one of its terminal ends between the housing part 122 and the housing part 142 to join the two housing parts 122 and 142 fixedly together thereat. The other end of the intermediate plate member 176 slidably engages an interior wall of the housing part 192 in a fluid tight manner. In this regard, the plate 176 cooperates with the housing parts 122, 142 and 192 as well as the end plates 193 and 194 to help define the pair of spaced apart pumping chambers 116 and 136 which are disposed on opposite sides of the plate 176 from one another. The end plate members 192 and 193 and intermediate plate member 176 cooperate with the housing parts 122, 142 and 192 to permit the volume of the pumping chambers 116 and 136 to be adjusted when the housing part 192 is moved axially relative to the housing parts 122 an 142 by a motive device (not shown) which is coupled mechanically to the housing part 192.

In order to permit the end plates 193 and 194 to help seal the pumping chambers 116 and 136, respectively, the end plate member 193 is connected fixedly at one end of the housing part 192 in a fluid tight manner and engages slidably an interior wall 117 of the pump chamber 116 defined by the housing parts 122 and 192. In a like manner, the end plate member 194 is connected fixedly at the opposite end of the housing part 192 in a fluid tight manner and engages slidably another interior wall 137 of the pumping chamber 136 defined by the housing part 142 and 192.

The end plate members 193 and 194 are carried along an axially extending path of travel by the housing part 192, while the housing parts 122 and 142 remain in a fixed stationary position. In this manner, as the end plate members 193 and 194 are moved toward and away from one another, relative to the internal plate 176, the size or volume of the pumping chambers 116 and 136 are decreased and increased relative to one another.

A pair of elongated rotary gears or vanes 125 and 195 are mounted rotatably in a parallel axially extending manner within pumping chambers 116 and 136. A rotatable plate 177 mounted rotatably to the chamber plate 176, supports rotatably slidably the gear 125 to enable it to slide axially between the two pumping chambers 116 and 136.

In order to enable the gear 125 to remain in full meshing engagement with gear 195 at all times, the gear 195 comprises an upper gear member 196 and a lower gear member 197 fixed together and mounted on a common shaft to rotate together as one gear. The gear members 196 and 197 are interconnected together by a small shaft or boss 198 which is mounted rotatably sealing in an aperture 178 in the chamber plate 176.

In order to permit the pump 512 to have both a positive and a negative displacement, the gear 125 and the individual gear members 196 and 197 are like dimensioned. Each of the gears 125, 196 and 197 includes a plurality of circumferentially equally spaced apart teeth and tooth spaces, such as teeth 126 and 146, respectively, and tooth spaces 127 and 147 respectively. The gear members 196 and 197 are co-operable with gear 125 to effect a meshing overlap relation to facilitate pumping of fluids through the pump chambers 116 and 136.

As best seen in FIG. 11, the gear 125 includes an enlarged body portion 128 which defines the gear teeth and tooth spaces, such as tooth 126 and tooth space 127, and a centrally disposed axially extending shaft 124 at the top end of the body 128. The shaft 124 is supported rotatably in an aperture 183 disposed in the end plate member 193. A set of bearings (not shown) are mounted within the aperture 183 to enable the shaft 124 to freely rotate therein. A seal (not shown) seals the shaft 124 within the aperture 183 in a fluid tight manner.

The bottom end of the body portion 128 includes a centrally disposed shaft 129 axially aligned with shaft 124 and supported rotatably in an aperture 184 disposed in the end plate member 194. A set of bearings (not shown) are mounted within the aperture 184 to enable the shaft 129 to freely rotate therein. A seal (not shown) seals the shaft 129 within the aperture 184 in a fluid tight manner.

As best seen in FIG. 11, the upper gear member 196 includes a body portion 185 fixed to the centrally disposed shaft 504 extending axially therefrom of the motor (FIG. 8) and functioning as a driver shaft to rotate the gear 195.

The body portion 185 is supported within a shaped opening 163 disposed within a plate 157 mounted rotatably in the end plate member 193. The rotatable plate 157 is sealed in a fluid tight manner by means (not shown) to the end plate member 193.

The shaped opening 163 corresponds to the cross-sectional configuration of the body portion 185 and receives the body 185 therein slidably in a fluid tight manner. In this regard, as best seen in FIG. 11, a portion of the body 186 is enabled to extend axially outwardly from the pumping chamber 136, and a portion of the body 185 is enabled to extend axially outwardly from the pumping chamber 116 as the associated housing part 192 is moved axially relative to the housing parts 122 and 142.

Figure 12:
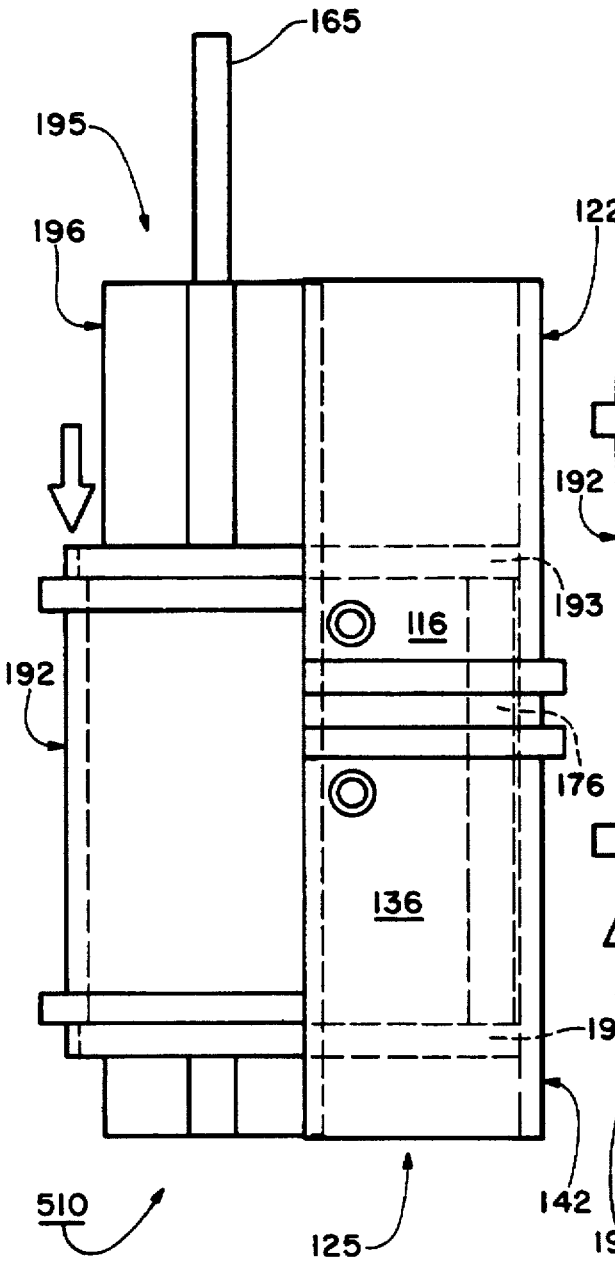
FIG. 12 is a side elevational view of the variable displacement apparatus component of FIG. 9 illustrating it adjusted to a positive displacement configuration.
Figure 13:
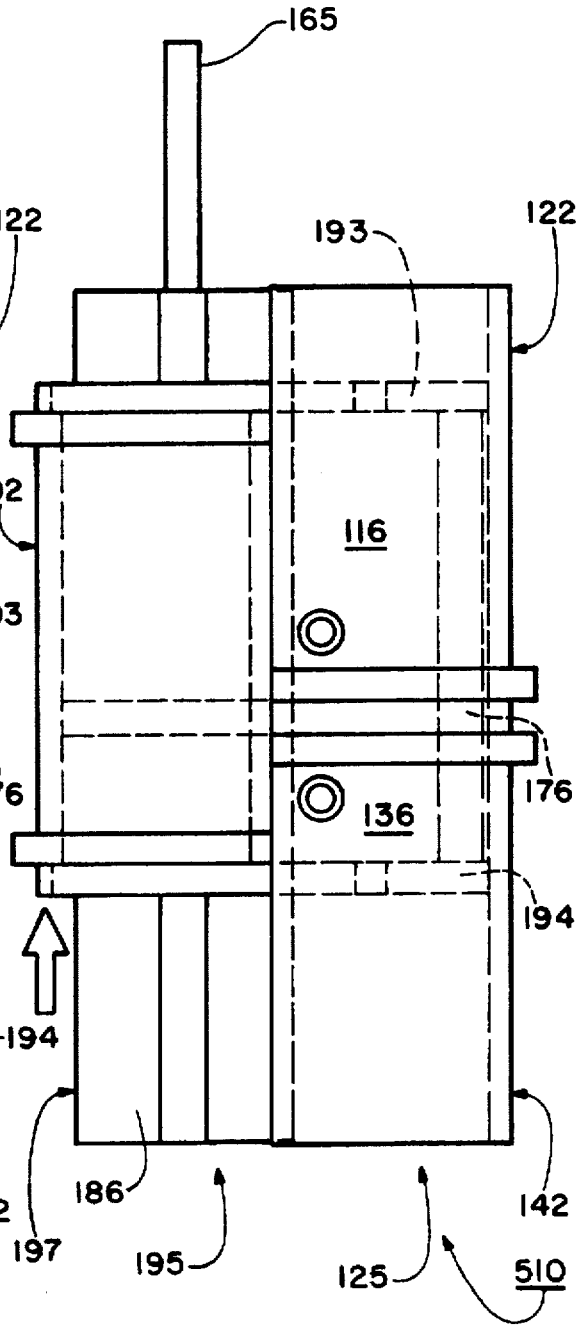
FIG. 13 is a side elevational view of the variable displacement apparatus component of FIG. 9, illustrating it adjusted to a negative displacement configuration.

The lower gear member 197 includes a body portion 186. The pump 510 functions as a two-way pump depending upon its particular application. In this regard, the pump 510 can cause the output shaft of the hydraulic motor 550 (FIG. 8) to rotate in either direction depending on the position of the housing part 192 as indicated in FIGS. 12 and 13.

The body portion 186, is supported rotatably within a rotatable plate 158 sealed to the end plate member 194 and is mounted slidably within a shaped opening 164 disposed in the plate 158. The body portion 186 is sealed to the opening 164 in a fluid tight manner. The shaped opening 164 corresponds to the cross sectional configuration of the body portion 186 and receives the body portion 186 slidably therewithin in a fluid tight manner.

From the foregoing, those skilled in the art will understand that the gear member 197 is mounted rotatably between the plate members 176 and 194 and rotatably slidably in end plate member 194. In this regard, the gear member 197 is adapted to move axially relative to the end plate 194 and chamber 136 for helping to control the volume of fluid passing through the chambers 116 and 136 as will be explained hereinafter in greater detail.

As best seen in FIG. 11, the gear 125 is substantially smaller in its overall length relative to the gear 195. The enlarged body portion 128, is supported rotatably in a shaped opening 179 disposed in the rotary plate 177. A dynamic seal (not shown) seals the body member 128 in the opening 179 in a fluid tight manner.

The gear 125 is free to rotate within the pumping chamber 116 and forms a substantially fluid tight-seal with the walls of the pumping chamber 116 defined by the housing part 122 and the end plate number 193.

The gear 125 is also free to rotate within the pumping chamber 136 and form a substantially fluid tight seal with the walls of the pumping chamber 136 defined by the housing part 142 and the end plate number 194.

The axial length of the gear 125 is sufficiently long to extend substantially the entire axial length of the body member 128 into pumping chamber 116 and substantially out of pumping chamber 186 when the end plate member 194 is moved axially toward the chamber plate 176. The axial length of the gear 125 is also sufficiently long to extend substantially the entire axial length of the body member 128 into pumping chamber 136 and substantially out of pumping chamber 116 when the end plate member 193 is moved axially toward and into abutting engagement with the chamber plate 176.

From the foregoing, those skilled in the art will understand that the gear 125 is mounted rotatably between the end plate number 193 and 194 and slides rotatably relative to the plate 177 permitting the gear 125 to extend into the chambers 116 and 136 to cooperate with gear 195 for controlling the volume of fluids pumping through the chambers 116 and 136, respectively.

As best seen in FIG. 11, the interior walls 117 and 137 each include a pair of openings 118 and 119, and 138 and 139, respectively. The openings 118 and 138 enable fluids to enter the respective pumping chamber 116 and 136 in response to the gears 125 and 195 rotating therewithin, while the openings 119 and 139 permit fluids to be discharged from the pumping chambers 116 and 136, respectively.

In operation, the housing parts 122 and 142 are joined fixedly together at the centrally disposed chamber plate 176 and have engaging abutment surfaces with housing part 192 via the keyed channel ways indicated generally at 170 and 171. The channel ways 170 and 171 are parallel to the axes of the shafts 124, 129 and 165. Thus, movement of the housing part 192 relative to the housing parts 122 and 142 along the channel ways 170 and 171 causes a change in the spacing between the end plates 193 and 194 relative to the chamber plate 176, which in turn, causes a portion of the gear members 196 and 197 to move relative to the pumping chambers 116 and 136, respectively as they slide rotatably within their respective rotatable plates 157 and 158. Simultaneously, the gear 125 moves slidably rotatably relative to the chamber plate 176 while maintaining a full intermediate relation with gear 195.

In FIG. 12, the housing parts 122 and 142 are shown in such a position that the perpendicular distance between the chamber plate 176 and the end plate member 194 is approximately the maximum that permits a maximum volume of fluids to be discharged from the pumping chamber 136.

In FIG. 13, the housing parts 122 and 142 are shown in such a position that the perpendicular distance between the chamber plate 176 and the end plate member 193 is approximately the maximum that permits a maximum volume of fluids to be discharged from the pumping chamber 116. From the foregoing, it should be understood that as the end plate members 193 and 194 move relative to the chamber plate 176 to help define the boundaries of the pumping chambers 116 and 136, respectively, the volume or size of the pumping chamber 116 has been significantly decreased in FIG. 12, while the volume of pumping chamber 136 has been increased. Thus, a much smaller volume of fluid will be able to be discharged from pumping chamber 116 and a much larger volume from pumping chamber 136, in response to each rotation of the gears 125 and 195. FIG. 13 illustrates the opposite relation.

When the spacing dimension between the end plates 193 and 194 is decreased or increased in accordance with the adjustment method of the present invention as illustrated in FIGS. 12 and 13, the gears 125 and 195 maintain a co-axial relation with respect to the respective housing parts 122, 142 and 192, defining the pumping chambers 116 and 136. The gears 125 and 195 also remain in a substantially fluid tight engagement with the walls 117 and 137 as well as the floor and ceiling of the chambers 116 and 136 defined by the end plate members 193 and 194. In the position such as illustrated in FIG. 12, even though the gears 125 and 195 maintain a constant meshing contact 9 the upper tooth spaces, such as spaces 127 and 147, are not filled with as much fluid as they were when the plates 176 and 194 were spaced at the maximum spaced distance as illustrated on FIG. 13. Because of this characteristic, as indicated in FIG. 13, the net volume of fluid transported from the inlets to the outlet in a complete revolution of the pump gears 125 and 195 is reduced in pumping chamber 136 and increased in pumping chamber 116 as the axial distance or spacing dimension between the plate 194 decreases relative to plate 176.

It will become apparent to those skilled in the art that the pumping gears or vanes may be either internal or external gears. Also, the shape of the vane or gear can be modified. Also, such vanes can also be helical in shape.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A variable displacement apparatus, comprising:

a pair of housing parts axially slidably sealably interconnected for defining an interior pumping chamber of a continuously variable volume;

a pair of end plates for helping to further define said pumping chamber, one of the end plates being fixed sealably to one of the housing parts and the other one of the end plates being fixed sealably to the other one of the housing parts for enabling the volume of the pumping chamber to be adjusted when the housing parts move axially relative to one another;

a pair of meshing elongated pumping members rotatably mounted in a parallel axially extending manner in the respective housing parts for pumping fluid from one side of the pumping chamber to another side of the pumping chamber;

at least one of the end plates having a rotatable member mounted sealably therein and having a shaped opening for receiving axially slidably sealingly therewithin one of the meshing pumping members to facilitate the movement of said end plates toward and away from one another; and an input port and an output port on the housing parts in fluid communications with said pumping chamber to facilitate admitting fluid to said pumping chamber and to facilitate discharging fluid from said pumping chamber to provide a pumping operation, whereby the discharge from the outlet can be continuously adjusted depending on the adjustment of the volume of the pumping chamber.

2. A variable displacement apparatus according to claim 1, wherein said pair of housing parts includes:

an input port housing part having said input port disposed therein and an output port housing part having said output port disposed therein.

3. A variable displacement apparatus according to claim 2, wherein said pumping chamber is generally cylindrically shaped, said pumping chamber having a pair of spaced apart semi-circular smooth interior walls to help facilitate the pumping of fluids therebetween, one of the interior walls having said input port disposed therein for admitting fluid to said pumping chamber and the other one of the interior walls having said output port disposed therein for permitting fluid to be discharged from said pumping chamber.

4. A variable displacement apparatus according to claim 3, wherein said pair of end plates includes:

a lower end plate mounted fixedly to said input port housing part for sealing slidable engagement with the interior wall having said output port to help facilitate relative axial displacement between said input port housing part and said output port housing part in a substantially fluid tight manner; and an upper end plate mounted fixedly to said output port housing part for sealingly slidable engagement with the interior wall having said output port to further help facilitate relative axial displacement between said input port housing part and said output port housing part in a substantially fluid tight manner.

5. A variable displacement apparatus according to claim 4, wherein said pair of meshing pumping members include:

an elongated rotatable vane mounted in said pumping chamber between said lower end plate and said upper end plate for dynamically sealingly engaging the interior wall having said input port to help facilitate moving fluids admitted into said pump in chamber via the input port toward the output port; and another elongated rotatable vane mounted in said pumping chamber between said lower end plate and said upper end plate for dynamically sealingly engaging the interior wall having said output port to help facilitate discharging fluid from said pumping chamber via the output port.

6. A variable displacement apparatus according to claim 5, wherein said rotatable member is integrally connected to said bottom end plate for supporting the first-mentioned vane rotatably.

7. A variable displacement apparatus according to claim 6, wherein the upper plate includes another rotatable member integrally connected thereto for supporting the second-mentioned vane rotatably.

8. A variable displacement apparatus according to claim 7, wherein said another rotatable member includes another shaped opening for receiving axially slidably sealably therewithin the other one of the meshing vanes to further facilitate the movement of said end plates toward and away from one another.

9. A variable displacement apparatus according to claim 7, wherein said elongated rotatable second-mentioned vane is further mounted at one of its ends rotatably sealing to said bottom plate and supported rotatably sealingly slidably at the other one of its ends by said another rotatable member to help facilitate relative movement of said lower plate and said upper plate toward and away from one another to decrease and increase the volume of said pumping chamber; and said elongated rotatable first-mentioned vane is further mounted at one of its ends rotatably sealingly to said upper plate and supported rotatably sealingly at the other one of its ends by said rotatable member to help facilitate relative movement of said lower plate and said upper plate toward and away from one another to decrease and increase the volume of said pumping chamber.

10. A method of continuously adjusting variable displacement apparatus, comprising:

using a pair of housing parts axially slidably sealably interconnected to define an interior pumping chamber of a continuously variable volume;

using a pair of end plates for helping to further define said pumping chamber, one of the end plates being fixed sealably to one of the housing parts and the other one of the end plates being fixed sealably to the other one of the housing parts for permitting the volume of the pumping chamber to be adjusted when the housing parts moved axially relative to one another;

using a pair of meshing elongated pumping vanes rotatably mounted in a parallel axially extending manner in the respective housing parts for pumping fluid from one side of the pumping chamber to another side of the pumping chamber;

at least one of the end plates having a rotatable member mounted sealably therein and having a shaped opening for receiving axially slidably sealably therewithin one of the meshing vanes to facilitate the movement of said end plates toward and away from one another; and said pumping chamber being in fluid communication with an input port and an output port on the housing parts, to facilitate admitting fluid to said pumping chamber and to facilitate discharging fluid from said pumping chamber; and adjusting axially slidably the spacing between said pair of end plates to increase and decrease the volume of said pumping chamber by a desired amount to adjust the effective pumping action of the variable displacement apparatus.

11. A variable displacement apparatus serving as a continuously variable hydraulic transmission between motive means and drive shaft means, comprising:

a continuously variable displacement pump driven by the motive means and having an input port and an output port for permitting a given volume of fluid to pass therethrough;

a hydraulic motor coupled to the drive shaft means and having another input port and another output port for permitting said given volume of fluid to pass therethrough;

input conduit means coupled between the input port of said pump and the output port of said motor for permitting said given volume of fluid passing through said motor to pass to the input port of said pump;

output conduit means coupled between the output part of said pump and the input port of said motor for permitting said given volume of fluid passing through said motor and said driving pump to be substantially equal;

means coupled to said pump for increasing and decreasing the interior volume thereof to adjust continuously the speed of the drive shaft in response to said given volume of fluid passing through said pump and said motor;

wherein said continuously variable pump includes:

a pair of housing parts axially slidably sealably interconnected for defining an interior pumping chamber of a continuously variable volume;

a pair of end plates for helping to further define said pumping chamber, one of the end plates being fixed sealably to one of the housing parts and the other one of the end plates being fixed sealably to the other one of the housing parts for permitting the volume of the pumping chamber to be adjusted when the housing parts move axially relative to one another;

a pair of meshing elongated pumping members rotatably mounted in a parallel axially extending manner in the respective housing parts for pumping fluid from one side of the pumping chamber to another side of the pumping chamber;

at least one of the end plates having a rotatable member mounted sealably therein and having a shaped opening for receiving axially slidably sealingly therewith one of the meshing members to facilitate the movement of said end plates toward and away from one another; and an input port and an output port on the housing parts in fluid communications with said pumping chamber to facilitate admitting fluid to said pumping chamber and to facilitate discharging fluid from said pumping chamber.

12. A variable displacement apparatus according to claim 11 wherein said continuously variable pumps includes:

hollow housing means having an interior wall with said input port and said output port disposed therein for permitting said given volume of fluid to pass therethrough.

* * * * *